US006177653B1

(12) United States Patent
Chiu et al.

(10) Patent No.: US 6,177,653 B1
(45) Date of Patent: Jan. 23, 2001

(54) ION SENSOR BULB-SHAPED GLOW PLUG ASSEMBLY

(75) Inventors: Randolph Kwok-Kin Chiu; Charles Dale Oakley, both of Davison; Gamdur Singh Mann, Grand Blanc, all of MI (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/376,698

(22) Filed: Aug. 18, 1999

(51) Int. Cl.[7] ..... F23Q 7/00
(52) U.S. Cl. ..... 219/270; 123/145 A
(58) Field of Search ..... 219/270, 544, 219/260; 123/145 A, 145 R; 361/264–266

(56) References Cited

U.S. PATENT DOCUMENTS 4,739,731 4/1988 Habich et al. .
4,816,643 * 3/1989 Zulauf et al. ..... 219/270

FOREIGN PATENT DOCUMENTS

3151825 * 8/1982 (DE) ..... 219/270
19737396 3/1998 (DE) .
19738915 3/1998 (DE) .
568519 * 11/1957 (IT) ..... 219/270
3-267616 * 11/1991 (JP) ..... 219/270
97/38223 10/1997 (WO) .

* cited by examiner

*Primary Examiner*—John A. Jeffery
(74) *Attorney, Agent, or Firm*—Vincent A. Cichosz

(57) ABSTRACT

An ion sensor glow plug assembly includes a shell for attachment to a cylinder head of a compression ignition engine and having a passageway extending axially therethrough. The ion sensor glow plug assembly also includes an insulator disposed at least partially in the passageway of the shell and having an aperture extending axially therethrough. The ion sensor glow plug assembly includes a glow bulb made of an insulative material and including a heating element disposed therein. The glow bulb extends through the aperture and into the passageway of the shell and is operatively connected to a source of power to create a heating circuit. The ion sensor glow plug assembly further includes a conductive material extending axially along the glow bulb and operatively connected to a source of power to create an ion sensing circuit.

20 Claims, 3 Drawing Sheets

ION SENSOR BULB-SHAPED GLOW PLUG ASSEMBLY

TECHNICAL FIELD

The present invention relates generally to glow plugs for engines and, more particularly, to an ion sensor glow plug assembly for an engine of a vehicle.

BACKGROUND OF THE INVENTION

It is known to provide an ion sensor for an engine of a vehicle. The ion sensor is used as a closed loop feedback to detect fuel injection timing and intensity of combustion in each cylinder of the engine so as to control and improve engine performance.

It is also known to provide a glow plug for a compression ignition engine such as a diesel engine. The glow plug typically has a ceramic tip that extends into a chamber of the engine. The purpose of the glow plug is to aid in cold starting of the diesel engine. Heat is conducted by conduction from the heating element through the ceramic tip and then by radiation and convection to the fuel-air mixture, which is a slow heat transfer process.

Although the above ion sensors and glow plugs have worked, it is desirable to combine the two to provide an ion sensor glow plug assembly. It is also desirable to provide an ion sensor glow plug assembly that heats quickly a fuel-air mixture in a compression ignition engine such as a diesel engine of a vehicle.

SUMMARY OF THE INVENTION

It is, therefore, one object of the present invention to provide an ion sensor glow plug assembly for an engine of a vehicle.

It is another object of the present invention to provide an ion sensor glow plug assembly that heats by radiation a fuel-air mixture in a compression ignition engine of a vehicle.

To achieve the foregoing objects, the present invention is an ion sensor glow plug assembly including a shell for attachment to a cylinder head of a compression ignition engine and having a passageway extending axially therethrough. The ion sensor glow plug assembly also includes an insulator disposed at least partially in the passageway of the shell and having an aperture extending axially therethrough. The ion sensor glow plug assembly includes a glow bulb made of an insulative material and including a heating element disposed therein. The glow bulb extends through the aperture and into the passageway of the shell and is operatively connected to a source of power to create a heating circuit. The ion sensor glow plug assembly further includes a conductive material extending axially along the glow bulb and operatively connected to a source of power to create an ion sensing circuit.

One advantage of the present invention is that an ion sensor glow plug assembly is provided for an engine of a vehicle. Another advantage of the present invention is that the ion sensor glow plug assembly incorporates a quartz bulb to heat quickly a fuel-air mixture by radiation in a compression ignition engine such as a diesel engine. Yet another advantage of the present invention is that the ion sensor glow plug assembly incorporates a tungsten heating element inside a quartz bulb or rod. Still another advantage of the present invention is that the ion sensor glow plug assembly can be used as a plain glow plug with a quartz bulb using radiation as the heat transfer medium by removing certain elements thereof. A further advantage of the present invention is that the ion sensor glow plug assembly aids in engine cold start and allows closed loop feedback control of engine timing and fueling of a compression ignition engine such as a diesel engine.

Other objects, features and advantages of the present invention will be readily appreciated, as the same becomes better understood after reading the subsequent description taken in conjunction with the accompanying drawings.

DESCRIPTION OF THE PREFERRED EMBODIMENT

Figure 1:
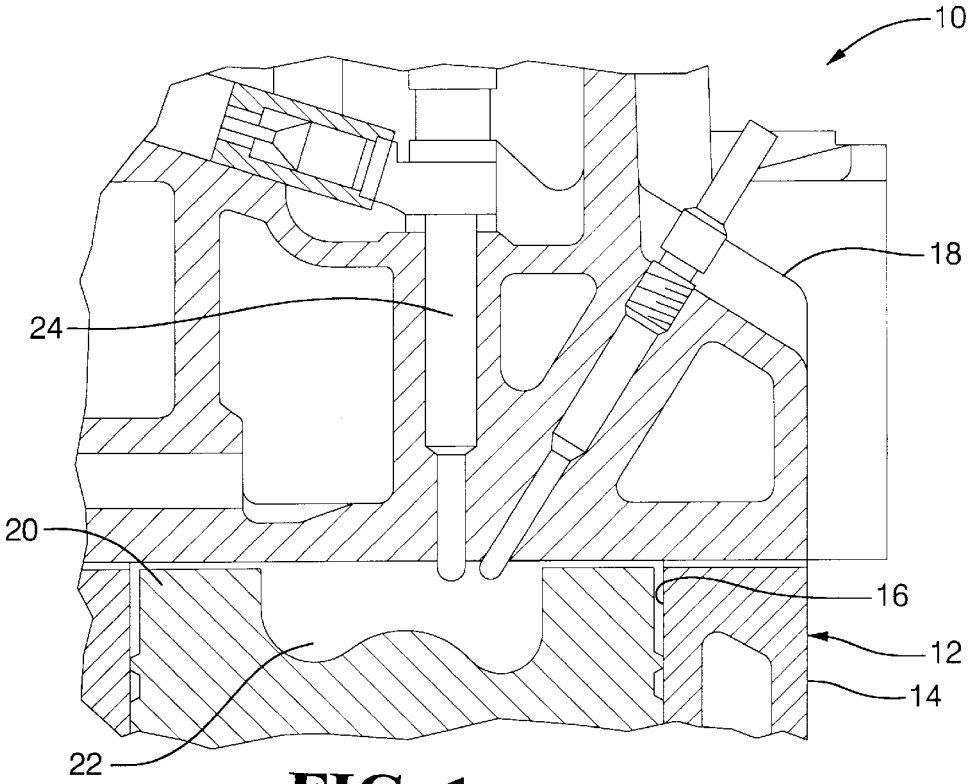
FIG. 1 is a fragmentary elevational view of an ion sensor glow plug assembly, according to the present invention, illustrated in operational relationship with an engine of a vehicle.
Figure 2:
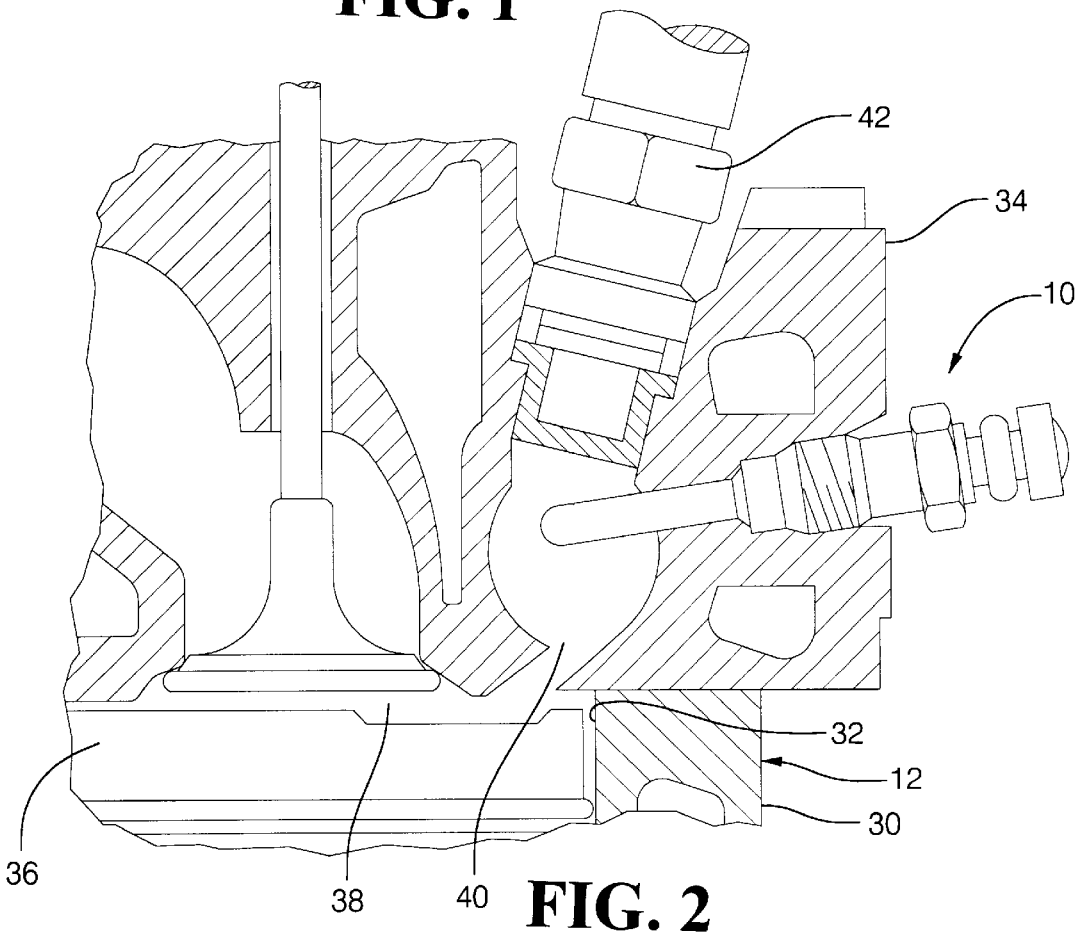
FIG. 2 is a view similar to FIG. 1 of the ion sensor glow plug assembly illustrated in operational relationship with another engine.

Referring to the drawings and in particular FIGS. 1 and 2, one embodiment of an ion sensor glow plug assembly 10, according to the present invention, is shown for a compression ignition engine, generally indicated at 12, such as a diesel engine in a vehicle (not shown). As illustrated in FIG. 1, the compression ignition engine 12 may be an open chamber type diesel engine including a cylinder block 14 defining a cylinder 16 closed by a cylinder head 18. The compression ignition engine 12 also includes a piston 20 reciprocal in the cylinder 16 and defines a recessed bowl, which together with the cylinder head 18 forms a combustion chamber 22. The compression ignition engine 12 includes an injection nozzle or injector 24 mounted in the cylinder head 18 which sprays fuel into the combustion chamber 22 for compression ignition therein. The compression ignition engine 12 further includes the ion sensor glow plug assembly 10 mounted in the cylinder head 18 and extending into the combustion chamber 22 for a function to be described. It should be appreciated that, except for the ion sensor glow plug assembly 10, the compression ignition engine 12 is conventional and known in the art.

As illustrated in FIG. 2, the compression ignition engine 12 may be pre-chamber type diesel engine including a cylinder block 30 defining a cylinder 32 closed by a cylinder head 34. The compression ignition engine 12 also includes a piston 36 reciprocal in the cylinder 32. The piston 36 and cylinder head 34 form a combustion chamber 38, which connects with a pre-combustion chamber or pre-chamber 40 within the cylinder head 34. The compression ignition engine 12 includes an injection nozzle or injector 42 mounted in the cylinder head 34 for injecting fuel into the pre-chamber 40. The compression ignition engine 12 includes the ion sensor glow plug assembly 10 mounted in the cylinder head 34 and extending into the pre-chamber 40 for a function to be described. It should be appreciated that, except for the ion sensor glow plug assembly 10, the compression ignition engine 12 is conventional and known in the art.

Figure 3:
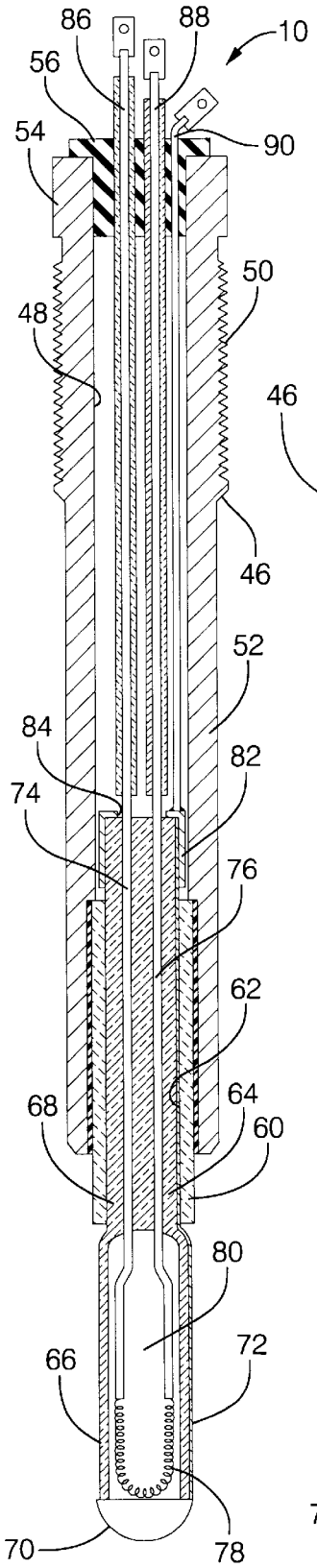
FIG. 3 is a fragmentary elevational view of the ion sensor glow plug assembly of FIGS. 1 and 2.
Figure 4:
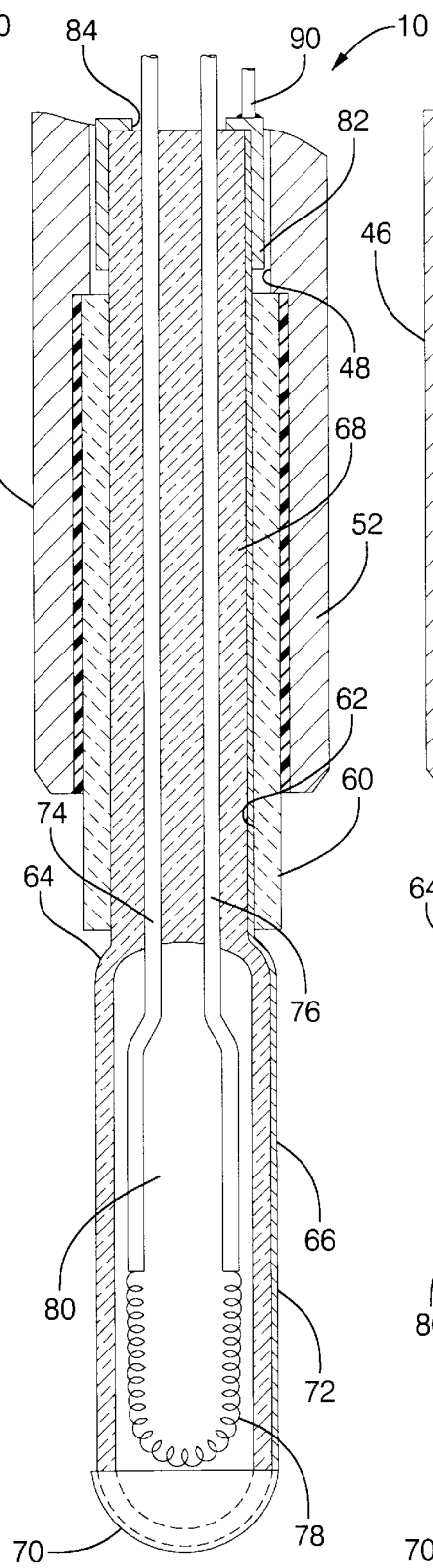
FIG. 4 is an enlarged fragmentary elevational view of a portion of the ion sensor glow plug assembly of FIG. 3.
Figure 5:
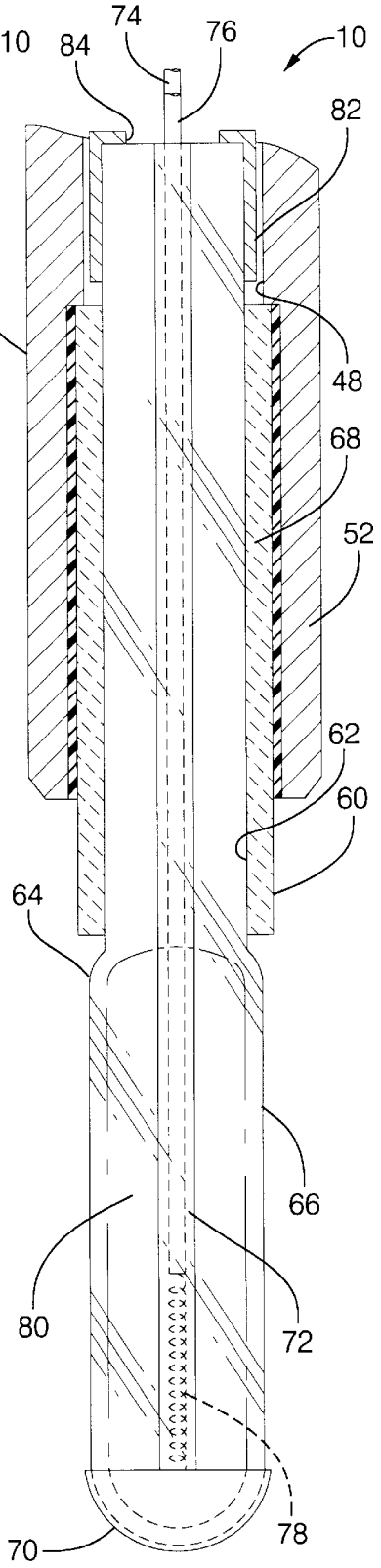
FIG. 5 is an enlarged fragmentary elevational side view of the portion of the ion sensor glow plug assembly of FIG. 4.

Referring to FIGS. 3 through 5, the ion sensor glow plug assembly 10 includes a housing or shell 46 extending axially for engaging the cylinder head 18,34. The shell 46 is generally cylindrical in shape and has a passageway 48 extending axially therethrough. The shell 46 has a plurality of exterior threads 50 for threaded engagement with the cylinder head 18,34. The exterior threads 50 are of a ten millimeter (10 mm) type. The shell 46 has a reduced diameter end 52 adjacent one end of the exterior threads 50 and a hexagonal shaped end 54 adjacent the other end of the exterior threads 50 for a function to be described. The hexagonal shaped end 54 is of a ten millimeter (10 mm) type. The shell 46 is made of a metal material such as steel.

The ion sensor glow plug assembly 10 may include a seal 56 disposed partially in the passageway 48 at the hexagonal shaped end 54 of the shell 46 and an electrical connector (not shown) disposed adjacent the seal 56 for a function to be described. The seal 56 is made of either a plastic or elastomeric material. It should be appreciated that the electrical connector is conventional and known in the art.

The ion sensor glow plug assembly 10 also includes an insulator 60 partially disposed in the passageway 48 at the reduced diameter end 52 of the shell 46. The insulator 60 is a sleeve being generally cylindrical in shape and extending axially. The insulator 60 has a passageway 62 extending axially therethrough. The insulator 60 is secured to the shell 46 by suitable means such as brazing or adhesively. The insulator 60 is made of a ceramic material such as alumina or Al2O3.

The ion sensor glow plug assembly 10 includes a glow bulb 64 partially disposed in the passageway 48 of the reduced diameter end 52 of the shell 46. The glow bulb 64 is generally bulb shaped and has a bulb portion 66 and a stem portion 68 extending axially from the bulb portion 66. The glow bulb 64 has an ion sensing area 70 at the tip of the bulb portion 66 and an ion sensing stripe 72 extending spaced axially from the ion sensing area 70 along an outer surface of the bulb portion 66 and stem portion 68. The ion sensing area 70 and ion sensing stripe 72 are made from a conductive material such as a platinum ink which are painted or cemented to the outer surface of the glow bulb 64 and then cured at elevated temperature to adhere the conductive material to the glow bulb 64. The stem portion 68 of the glow bulb 64 extends axially from the bulb portion 66 through the aperture 62 of the insulator 60 and into the passageway 48 if the shell 46. The stem portion 68 is secured to the insulator 60 by suitable means such brazing. The glow bulb 64 is made of an insulative material such as quartz.

The ion sensor glow plug assembly 10 includes a first electrode 74 and a second electrode 76 spaced radially and extending axially through the stem portion 68 of the glow bulb 64 and terminating inside the bulb portion 66 of the glow bulb 64. The first electrode 74 and second electrode 76 are made of a conductive material such as Invar or Super-Invar, which are known materials in the art. The ion sensor glow plug assembly 10 also includes a heating element 78 disposed in the bulb portion 66 and interconnecting the ends of the first electrode 74 and second electrode 76. The heating element 78 is spaced axially from the tip of the bulb portion 66. The heating element 78 has one end welded to the end of the first electrode 74 and another end welded to the end of the second electrode 76. The heating element 78 is made of a conductive material such as tungsten (W) in the form of a coiled wire. It should be appreciated that the first electrode 74, second electrode 76 and heating element 78 are molded inside the glow bulb 64.

The ion sensor glow plug assembly 10 includes a gas 80 trapped inside the bulb portion 66 of the glow bulb 64. The gas 80 is an inert gas such as Argon or Nitrogen. The gas 80 creates an internal partial pressure inside the bulb portion 66 of the glow bulb 64.

The ion sensor glow plug assembly 10 includes a cap 82 disposed over a free end of the stem portion 68 of the glow bulb 64. The cap 82 is generally cylindrical in shape and has an aperture 84 extending axially therethrough to allow the first electrode 74 and second electrode 76 to extend through the cap 82 without contacting the cap 82. The cap 82 is made of a metal material and retained by suitable means such as brazing to the glow bulb 64. It should be appreciated that the cap 82 contacts the ion sensing stripe 72.

The ion sensor glow plug assembly 10 includes a first insulated or heater terminal 86 extending through the seal 56 and attached to the first electrode 74 by suitable means such as welding. The first insulated terminal 86 matingly engages the electrical connector. The first insulated terminal 86 is made of a metal material such as nickel (Ni). The ion sensor glow plug assembly 10 also includes a second insulated or heater terminal 88 extending through the seal 56 and attached to the second electrode 76 by suitable means such as welding. The second insulated terminal 88 matingly engages the electrical connector. The second insulated terminal 88 is made of a metal material such as nickel (Ni). The ion sensor glow plug assembly 10 further includes a third insulated or ion terminal 90 extending through the seal 56 and attached to the cap 82 by suitable means such as welding. The third insulated terminal 90 matingly engages the electrical connector. The third insulated terminal 90 is made of a metal material such as nickel (Ni). It should be appreciated that the first insulated terminal 86 and first electrode 74 are a first heater terminal for the heating element 78 and the second insulated terminal 88 and second electrode 76 are a second heater terminal for the heating element 78. It should also be appreciated that the third insulated terminal 90, cap 82, ion sensing strip 72 and ion sensing area 70 form an ion sensing circuit.

To assemble the ion sensor glow plug assembly 10, the heating element 78 is joined such as by welding to the first electrode 74 and second electrode 76. The heating element 78, first electrode 74 and second electrode 76 are trapped inside the bulb portion 66 and stem portion 68 of the glow bulb 64. Trapped inside the bulb portion 66 is the gas 80 to create an internal partial pressure. The ion sensing area 70 at the tip of the bulb portion 66 and ion sensing stripe 72 along the outer surface of the bulb portion 66 and stem portion 68 are painted or cemented to the bulb 64 and then cured at elevated temperature to adhere them to the glow bulb 64. The insulator 60 and cap 82 are brazed or cemented to the glow bulb 64. The first insulated terminal 86 is joined or attached to the first electrode 74 by suitable means such as welding. The second insulated terminal 88 is joined or attached to the second electrode 76 by suitable means such as welding. The third insulated terminal 90 is joined or attached to the cap 82 by suitable means such as welding. The insulator 60 is then inserted into the passageway 48 and joined or attached to the shell 46 by suitable means such as brazing. The seal 56 is then inserted into the upper or open end of the passageway 48 of the shell 46. The ion sensor glow plug assembly 10 is then completely assembled.

In operation of the ion sensor glow plug assembly 10, current flows from the electrical connector to the first insulated terminal 86, which passes through the first electrode 74 and heating element 78 and second electrode 76 and second insulated terminal 88 back to the electrical connector to form a glow plug circuit. Heating of the fuel-air mixture, in this case, is mainly by radiation through the quartz material of the glow bulb 64, which is faster than heating by conduction and convection. The third insulated terminal 90, cap 82, ion sensor stripe 72 and ion sensor area 70 carry the supply voltage from the electrical connector for the ion sensor circuit. When there is combustion in the cylinder 16,32, the burnt gases are ionized and conduct or carry current from the electrical connector through the third insulated terminal 90 to the cap, ion sensor stripe 72 and ion sensor area 70 and through the ionized gas to an engine ground, which is the piston 22,36 or the shell 46. It should be appreciated that removing the ion sensing area 70, ion sensing stripe 72, metal cap 82 and terminal 90 will allow the assembly 10 to operate as a plain glow plug with a quartz material glow bulb 64 using radiation as the heat transfer medium.

Figure 7:
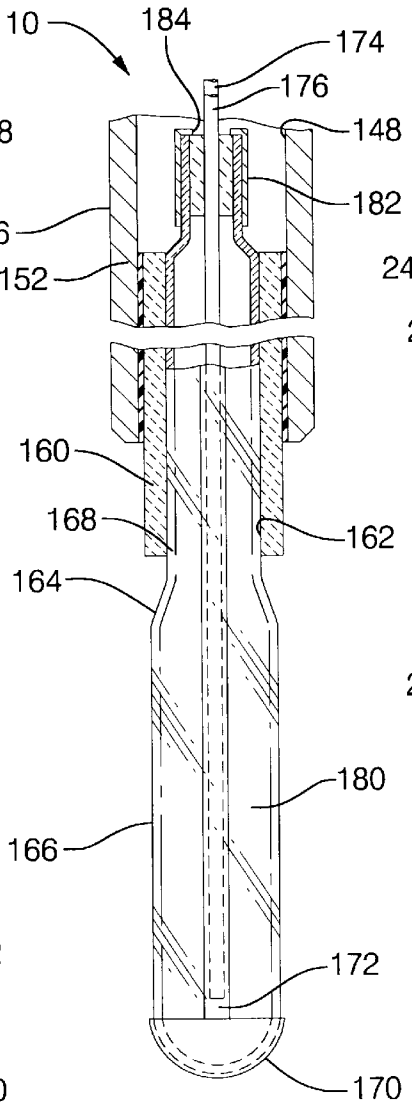
FIG. 7 is an enlarged fragmentary elevational side view of the ion sensor glow plug assembly of FIG. 6.
Figure 6:
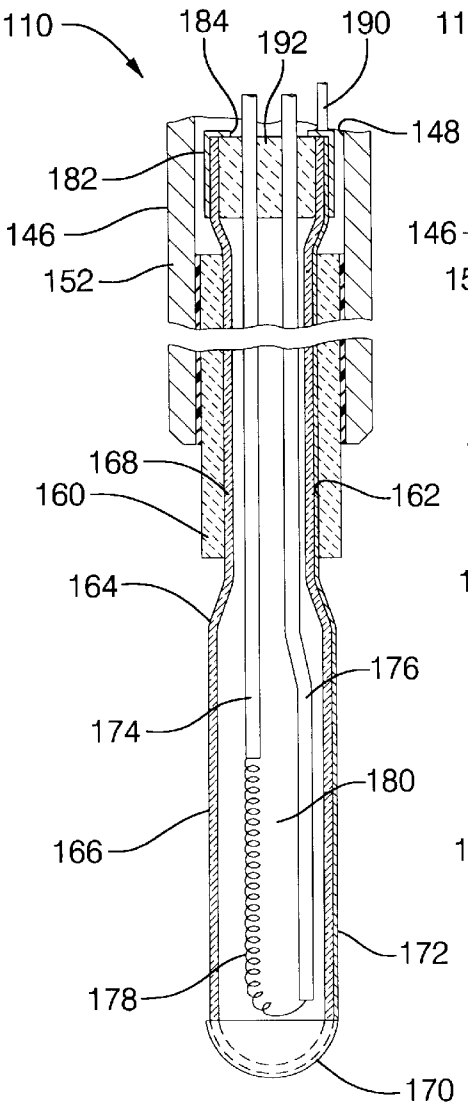
FIG. 6 is an enlarged fragmentary elevational view of another embodiment, according to the present invention, of the ion sensor glow plug assembly of FIGS. 1 and 2.

Referring to FIGS. 6 and 7, another embodiment 110, according to the present invention, of the ion sensor glow plug assembly 10 is shown. Like parts of the ion sensor glow plug assembly 10 have like reference numerals increased by one hundred (100). In this embodiment, the ion sensor glow plug assembly 110 includes the glow bulb 164 having a hollow first stem portion 168. The first electrode 174 may terminate before or be shorter than the second electrode 176 in the bulb portion 166. The first electrode 174, second electrode 176 and heating element 178 are inserted and positioned inside the bulb portion 166 and first stem portion 168. The ion sensor glow plug assembly 110 also includes a second stem portion 192 disposed in the open end of the first stem portion 168. The second stem portion 192 is then softened by heating and pinched shut around the first electrode 174 and second electrode 176. The inside of the glow bulb 164 is filled with the inert gas 180. The ion sensor glow plug assembly 110 operates similar to the ion sensor glow plug assembly 10.

Figure 9:
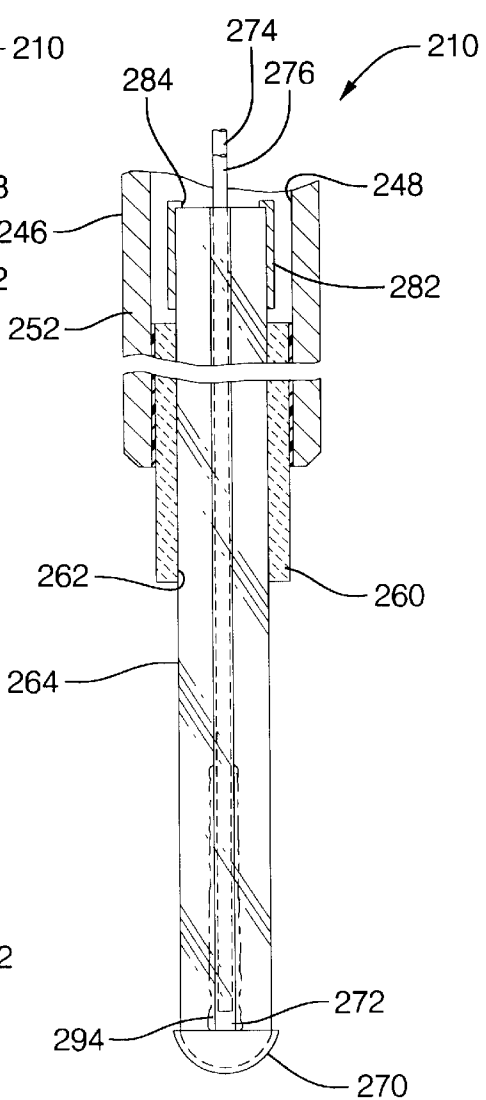
FIG. 9 is an enlarged fragmentary elevational side view of the ion sensor glow plug assembly of FIG. 8.
Figure 8:
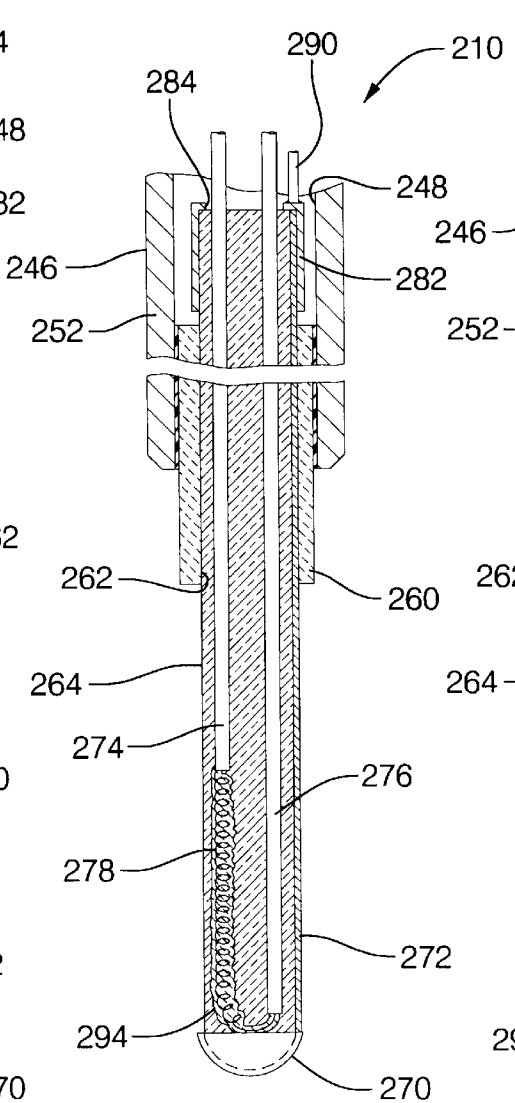
FIG. 8 is an enlarged fragmentary elevational view of yet another embodiment, according to the present invention, of the ion sensor glow plug assembly of FIGS. 1 and 2.

Referring to FIGS. 8 and 9, yet another embodiment 210, according to the present invention, of the ion sensor glow plug assembly 10 is shown. Like parts of the ion sensor glow plug assembly 10 have like reference numerals increased by two hundred (200). In this embodiment, the ion sensor glow plug assembly 210 includes the glow bulb 264 as a solid rod of quartz material extending axially. The first electrode 274 may terminate before or be shorter than the second electrode 276 in the glow bulb 264. The first electrode 274, second electrode 276 and heating element 278 are molded inside the rod for the glow bulb 264. The ion sensor glow plug assembly 210 also includes a coating 294 about the heating element 278 to prevent cracking or shattering of the quartz rod for the glow bulb 264 by the heating element 278 during operation, due to differential thermal expansion between the heating element 278 and glow bulb 264. The coating 294 is made of an insulative material such as porous glass or ceramic. The coating 294 is applied to the heating element 278 in the form of a paste and then molded inside the quartz rod of the glow bulb 264. The coating 294 acts as a cushion for the faster expanding heating element 278 without cracking or shattering the glow bulb 264 during heating operation. The ion sensor glow plug assembly 210 operates similar to the ion sensor glow plug assembly 10.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A glow plug assembly comprising:

a shell for attachment to a cylinder head of a compression ignition engine and having a passageway extending axially therethrough;

an insulator disposed at least partially in said passageway of said shell and having an aperture extending axially therethrough; and a glow bulb made of an insulative material and including a heating element disposed therein, said glow bulb extending through said aperture and into said passageway of said shell and operatively connected to a source of power to create a heating circuit.

2. A glow plug assembly as set forth in claim 1 wherein said insulative material comprises a quartz material.

3. A glow plug assembly as set forth in claim 1 wherein said glow bulb has a bulb portion and a stem portion, said stem portion extending axially through said aperture of said insulator.

4. A glow plug assembly as set forth in claim 3 wherein said bulb portion is hollow and said stem portion is solid.

5. A glow plug assembly as set forth in claim 3 wherein said bulb portion and said stem portion are hollow.

6. A glow plug assembly as set forth in claim 1 wherein said glow bulb is a solid rod extending axially through said aperture of said insulator.

7. A glow plug assembly as set forth in claim 6 including a coating disposed about said heating element.

8. A glow plug assembly as set forth in claim 1 including a first electrode connected to said heating element and a first terminal interconnecting said first electrode and a source of power.

9. A glow plug assembly as set forth in claim 8 including a second electrode connected to said heating element and a second terminal interconnecting said second electrode and a source of power.

10. A glow plug assembly as set forth in claim 1 wherein said first electrode is shorter than said second electrode.

11. A glow plug assembly as set forth in claim 1 including an inert gas disposed in said glow bulb.

12. An ion sensor glow plug assembly for a compression ignition engine comprising:

a shell for attachment to a cylinder head of a compression ignition engine and having a passageway extending axially therethrough;

an insulator disposed at least partially in said passageway of said shell and having an aperture extending axially therethrough; and a glow bulb made of an insulative material and including a heating element disposed therein, said glow bulb extending through said aperture and into said passageway of said shell and operatively connected to a source of power to create a heating circuit; and a conductive material extending axially along said glow bulb and operatively connected to a source of power to create an ion sensing circuit.

13. An ion sensor glow plug assembly as set forth in claim 12 wherein said conductive material comprises an ion sensor area at a tip of said glow bulb and an ion sensor stripe extending axially from said ion sensor area.

14. An ion sensor glow plug assembly as set forth in claim 13 including a cap disposed over a free end of said glow bulb and operatively connected to a source of power.

15. An ion sensor glow plug assembly as set forth in claim 12 wherein said insulative material comprises a quartz material.

16. An ion sensor glow plug assembly as set forth in claim 12 wherein said glow bulb has a bulb portion and a stem portion, said stem portion extending axially through said aperture of said insulator.

17. An ion sensor glow plug assembly as set forth in claim 16 wherein said bulb portion is hollow and said stem portion is solid.

18. An ion sensor glow plug assembly as set forth in claim 16 wherein said bulb portion and said stem portion are hollow.

19. An ion sensor glow plug assembly as set forth in claim 12 wherein said glow bulb is a solid rod extending axially through said aperture of said insulator.

20. An ion sensor glow plug assembly for a diesel engine comprising:

a shell for attachment to a cylinder head of a compression ignition engine and having a passageway extending axially therethrough;

an insulator disposed at least partially in said passageway of said shell and having an aperture extending axially therethrough; and a bulb made of an insulative material and having a bulb portion and a stem portion, said bulb including a heating element disposed in said bulb portion and a first electrode and a second electrode connected to said heating element and extending axially through said stem portion, said stem portion extending through said aperture and into said passageway of said shell and said first electrode and said second electrode being operatively connected to a source of power to create a heating circuit; and a conductive material forming an ion sensing area at a tip of said bulb portion and an ion sensing stripe extending axially along said bulb portion and said stem portion and operatively connected to a source of power to create an ion sensing circuit.

* * * * *